US005873789A

United States Patent [19]

Torriano

[11] Patent Number: 5,873,789

[45] Date of Patent: Feb. 23, 1999

[54] GOLF SWING TRAINING DEVICE

[76] Inventor: Simone Torriano, 1 Palace Pier Court, Apt. 2502, Etobicoke, Ontario, Canada, M9W 3W9

[21] Appl. No.: 75,403

[22] Filed: May 11, 1998

[51] Int. Cl.[6] ..... A63B 69/36

[52] U.S. Cl. ..... 473/220; 362/259

[58] Field of Search ..... 473/220

[56] References Cited

U.S. PATENT DOCUMENTS 4,108,441 8/1978 Tredway ..... 473/220

5,082,282 1/1992 Hernberg ..... 473/220

5,169,150 12/1992 Tindale ..... 473/220

*Primary Examiner*—George J. Marlo

[57] ABSTRACT

A golf club shaped swing training device provides visual indication of club position during a club swinging motion. A first laser diode produces a first laser line from the upper end of the shaft and second and third laser diodes produce second and third laser lines respectively from the bottom face and the front face of the head portion of the device. Each of the laser lines emanates from the device as a concentrated beam to impinge and be readily visible on a training surface remote of the device for independently tracking movement of the shaft, the bottom face and the front face of the head portion of the device.

6 Claims, 5 Drawing Sheets

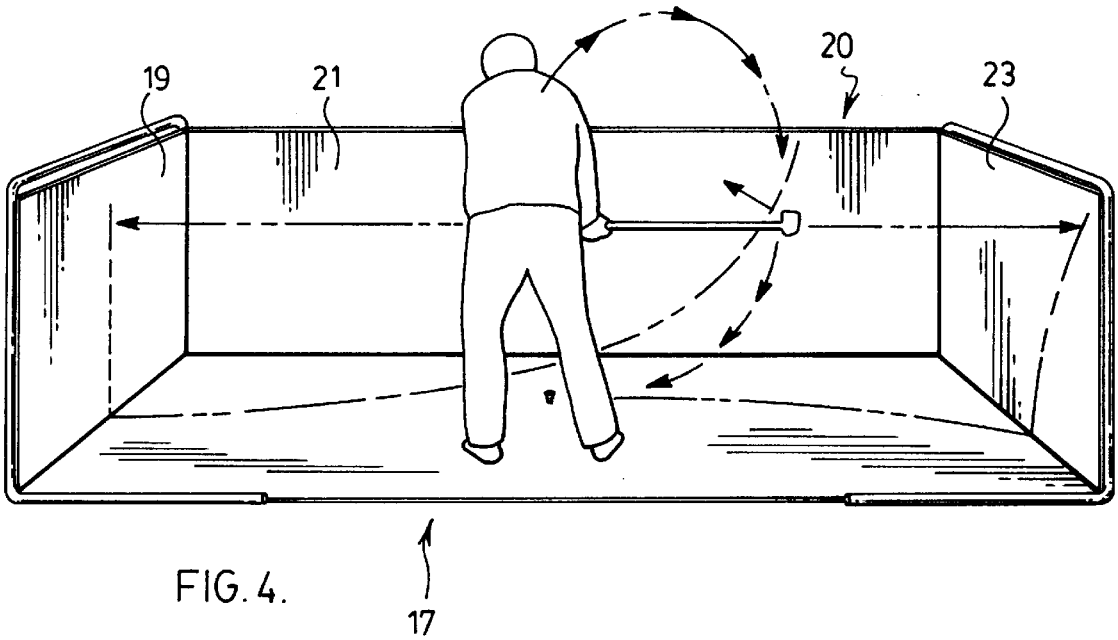
FIG. 4.
FIG. 5.
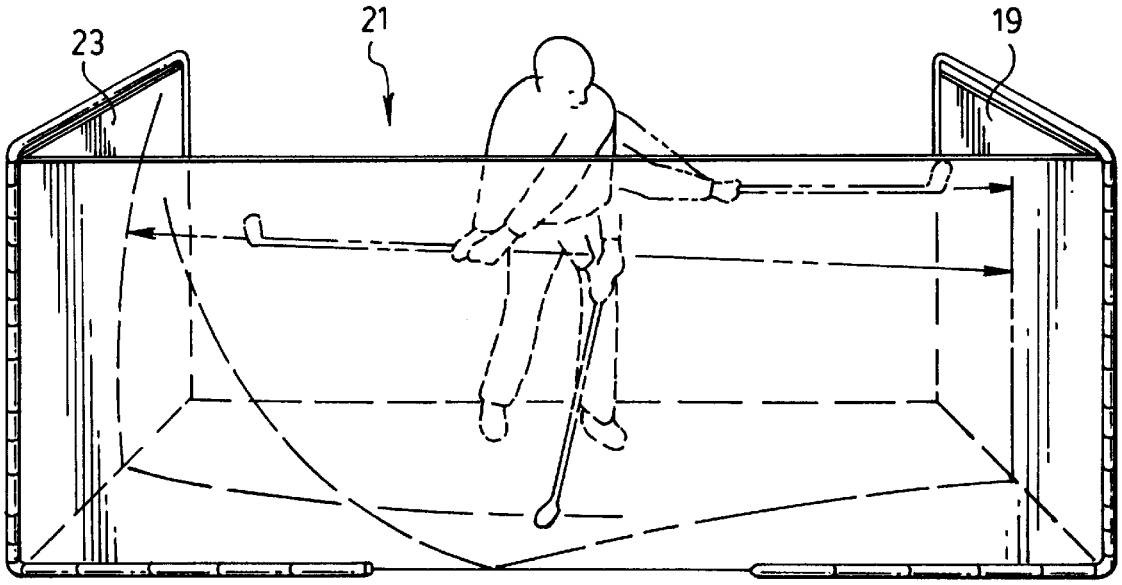

GOLF SWING TRAINING DEVICE

FIELD OF THE INVENTION

The present invention relates to a device used for the training of a golf swing.

BACKGROUND OF THE INVENTION

Almost all people who play golf, from the novice to the expert player, at some time, require some work on their swing. Even with video camera, it is difficult to see exact positioning of the club and more particularly, the positions of the shaft and head of the club during the back swing and the down swing.

Proper hand movement is a critical aspect of a proper back swing. When the hands are moved properly, the shaft of the club should be in a specific positions during the back swing. In addition, the face of the club should be at a specific orientation to avoid the face from either being closed or opened at impact which otherwise produces pulling or pushing of the golf ball.

There are many different types of golf swing training devices currently available. Some of these devices include lights helpful for following a swing path. However, there does not appear to be anything available in the way of a lighted swing training device which shows positioning of the face relative to the rest of the club during different parts of the swing and usable under different lighting conditions.

By way of example, U.S. Pat. Nos. 5,000,456 and 5,082,282 both describe golf club shaped swing trainers which include lights at opposite ends of the club. These lights are sufficient in a darkened room to see a swing path.

The devices of the above two patents would not be usable under well lighted conditions because the light from these devices could not be discerned from the ambient light. They particularly would not be useful in outdoor conditions under bright sunlight. In addition, the devices of these two patents are not able to demonstrate club face positioning, i.e. whether or not the club face is open or closed at different points of the swing and in particular during the back swing where club face positioning is most important.

SUMMARY OF THE INVENTION

The present invention provides a golf swing training device which provides visual indication of club head position and orientation during a club swinging motion under substantially all lighting conditions.

More particularly, the device of the present invention has a golf club shape including a shaft portion with an upper end for gripping the device and a lower end to which a head portion is secured. The head portion includes a bottom face and a front face.

The device further includes a first laser diode emitting a first laser line from the upper end of the shaft and second and third laser diodes emitting second and third laser lines respectively from the bottom face and the front face of the head portion. Each of the laser lines emanates from the device as a concentrated beam to impinge and be readily visible regardless of lighting conditions on a training surface remote of the device for independently tracking movement of the shaft, the bottom face of the head portion and the front face of the head portion during the swing.

BRIEF DESCRIPTION OF THE DRAWINGS

The above as well as other advantages and features of the present invention will be described in greater detail according to the preferred embodiments of the present invention in which;

FIGS. 4 and 5 show, from the back and the front respectively, a user training with the device of FIG. 1 in an enclosure made in accordance with a preferred embodiment of the invention;

DETAILED DESCRIPTION ACCORDING TO THE PREFERRED EMBODIMENTS OF THE PRESENT INVENTION

Figure 1:
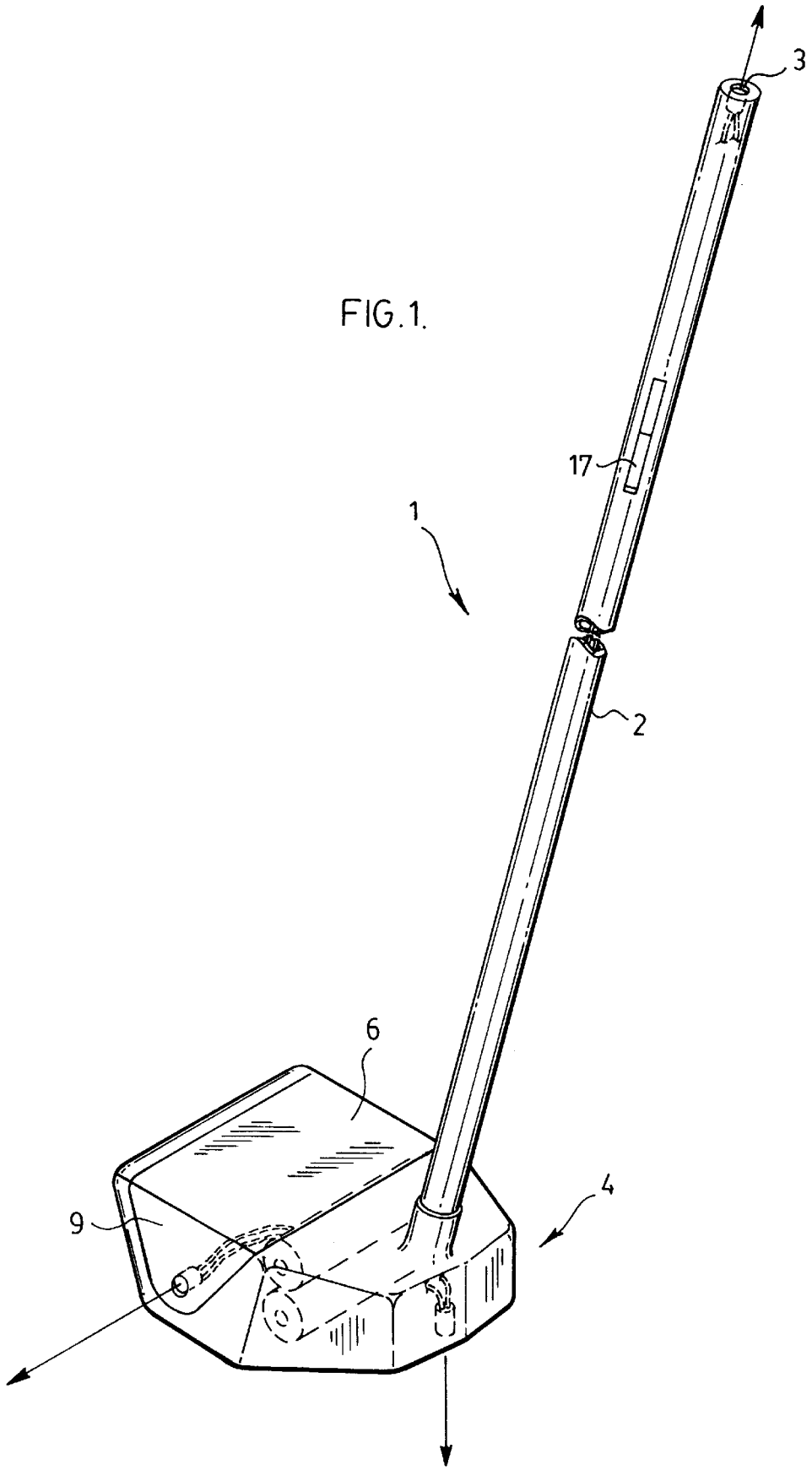
FIG. 1 is a perspective view of a golf swing training device according to a preferred embodiment of the present invention.

FIG. 1 shows a golf swing training device generally indicated 1. As will be seen, the device is the general shape and size of a golf club to help simulate proper conditions for a good club swing.

Figure 3:
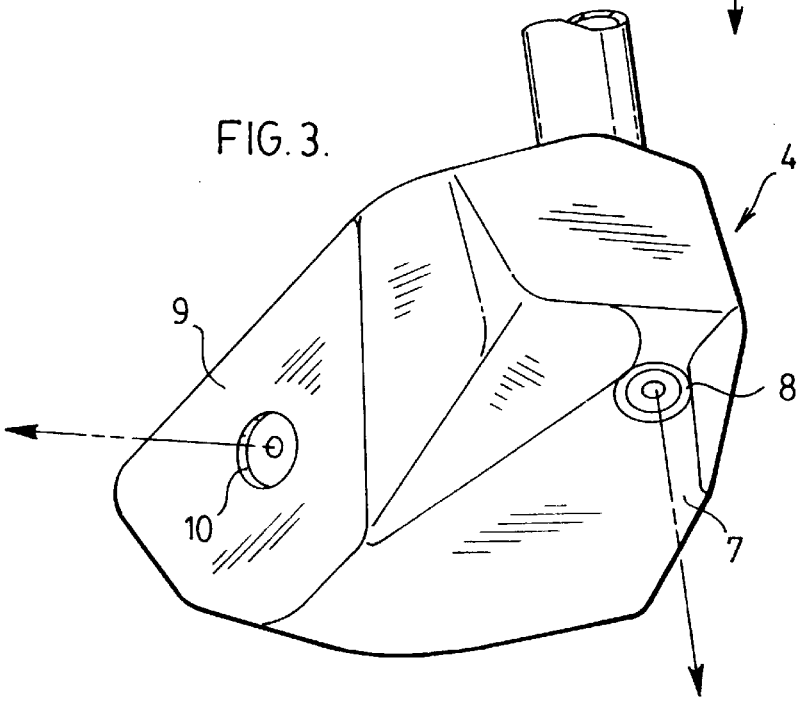
FIG. 3 is an enlarged bottom perspective view of the head of the training device of FIG. 1.

Device 1 includes an elongated shaft 2 having a head portion generally indicated at 4 at the bottom of the shaft. Head portion 4 has a front face 9 and, as better seen in FIG. 3 of the drawings, has a bottom face 7.

Figure 6:
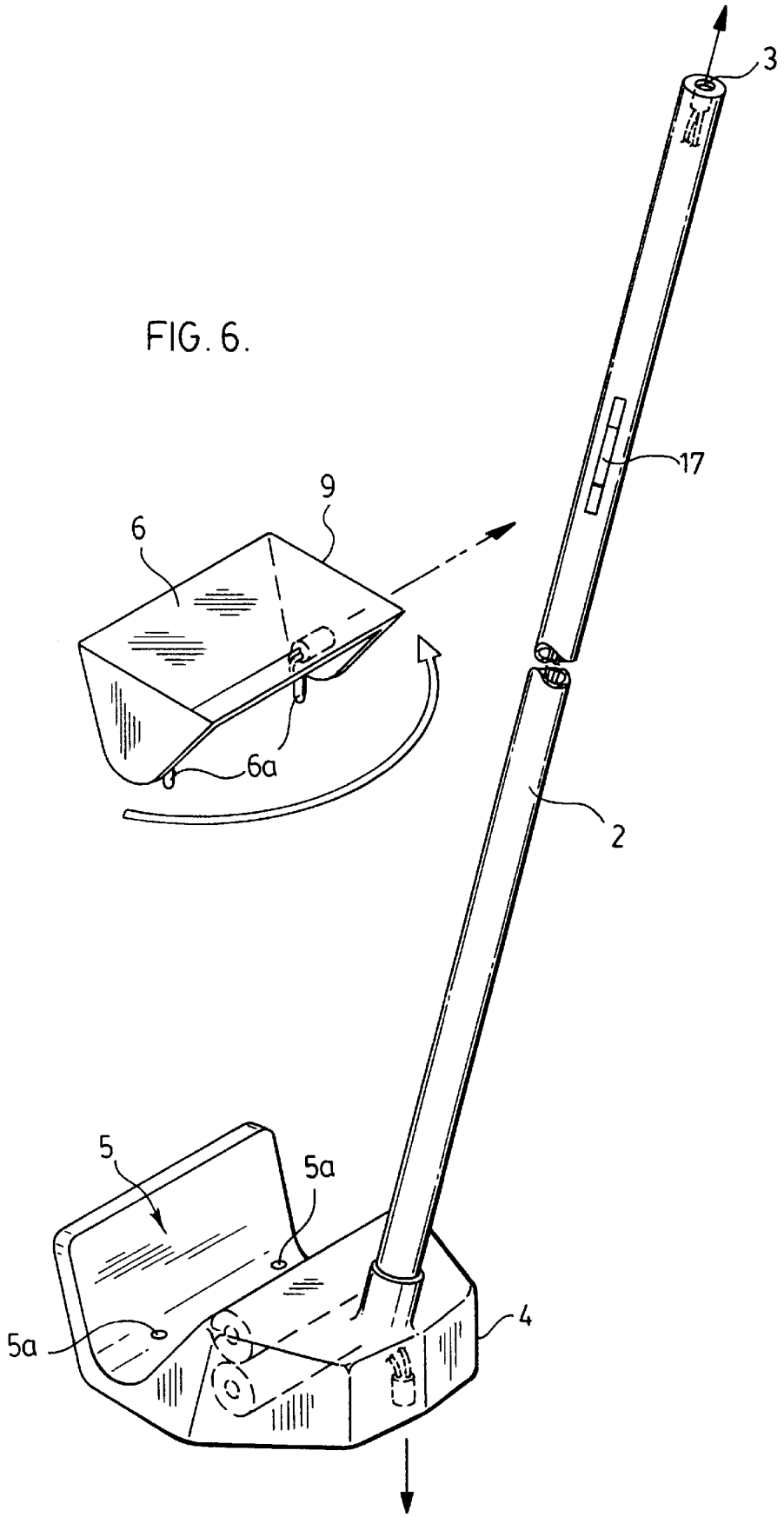
FIG. 6 is a further exploded perspective view of the training device of FIG. 1.

In the preferred embodiment as shown, the front face 9 of the head is formed as part of an insert 6 which releasably locks into a hollow 5 in the head 4. Insert 6, as shown in FIG. 6 of the drawings, is reversible within the head and the head itself is symmetrical to opposite sides of its center where it is joined to the shaft. This makes the device usable for both right and left handed golfers.

Figure 2:
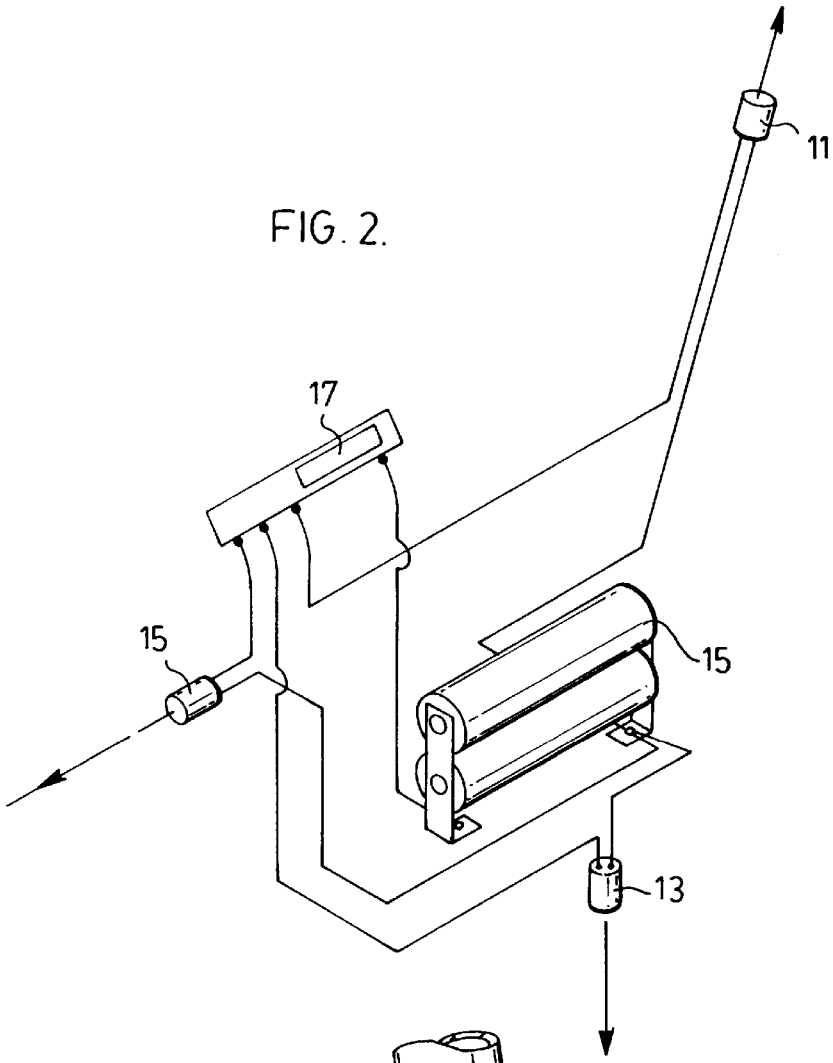
FIG. 2 is a schematic view of the overall lighting assembly used in the device of FIG. 1.

The device includes a lighting and wiring assembly shown in FIG. 2 of the drawings. This assembly comprises three separate lights and, more specifically, laser diodes 11, 13 and 15. Each of the diodes is wired to a common electrical source 15 with a single on/off switch 17 for operation of the laser diodes. As seen in FIG. 1 of the drawings, switch 17 is located on the shaft.

To help the reversing of insert 6, it is provided with its own circuit board with electrical prongs 6*a*. These prongs which plug into electrical openings 5*a* in the head 5 of the device regardless of the direction of the insert, have a dual function. They complete the circuit to the insert and they also hold the insert with the head.

Switch 17 is a three position switch. It can be set so that all of the laser diodes are off, in a first ON position where only diodes 11 and 13 are activated, or in a second ON position where all of the diodes are activated.

The bottom face 7 of the head is provided with an opening 8 while the front face 9 is provided with an opening 10. Laser diodes 13 and 15 are placed within the head to project concentrated beams in the form of laser lines out of the head through openings 8 and 10 respectively. These two laser lines which are totally distinct are at generally right angles to one another. The laser line emanating from the bottom of the head is directly beneath the bottom end of shaft 2 slightly out of alignment with the longitudinal axis of the shaft. This allows the bottom laser line 2 to be directed straight downwardly while the shaft is at a slight upward inward angle towards the golfer as is the case when the golfer grips a normal club with the club head square to the ground.

Shaft 2 which is hollow is provided at its upper end with a further opening generally indicated at 3 through which laser diode 11 projects its laser line.

Due to the nature of the three laser lines, they can be projected to an extremely localized point on a surface remotely of the club. This is one of the key features of the present invention as explained in greater detail in reference to FIGS. 4 and 5 of the drawings. More particularly, training device 1 is used in association with a surrounding training surface and, in this case, that training surface is provided by a three sided enclosure generally indicated at 20. This enclosure which is open from one side comprises opposite end walls 19 and 23 separated by a side wall 21. The user enters the enclosure from its open side facing side wall 21.

At any point during the back swing the user is able to stop and easily see where the different parts of the training device are positioned relative to one another. One of the important positions of a golf swing is the one shown in FIG. 4 where, after the initial take away, the hands and wrists begin to cock. The club should be essentially horizontal in this position and it should also be generally in line with the hips of the user. The accuracy of the positioning of the training device can quickly and easily be ascertained by looking at the opposite end walls 19 and 23 of the enclosure. When switch 17 is in the first ON position, the laser line from the upper end of the shaft where the shaft is gripped by the user projects onto wall 19 while the laser line from the bottom of the head projects unto wall 23. These two laser lines should be at the same height on both of the walls and should also be at the same position across each of the walls.

If the hands of the user are not in the appropriate position, the correction can easily be made by adjusting the positions of the laser lines on the enclosure ends 19 and 23.

Again, an important feature of the present invention is that the laser lines project well away from the training device allowing a full natural swing and still enabling the user to easily visually ascertain club positioning. This is achieved according to the present invention due to the very concentrated nature of the laser lines which can project to and focus on a surface at a substantial distance from the device. Accordingly the training enclosure is much longer than the swing path of the training device allowing a full swing. In order to enhance the ease with which the laser lines can be seen in all lighting conditions, they are preferably colored, i.e. not white. For example, red laser lines which contrast in color to most lights are extremely easy to see even in well lighted conditions.

It is also important when the training device is in the FIG. 4 position that the face of the club be oriented such that it is pointing in the proper direction. This direction is one which has the club face parallel to horizontal facing directly at wall 21 of the enclosure. Again, the user can easily determine whether or not the face is in the proper position by moving switch 17 to its second ON position to activate diode 15 and then viewing the laser line from this diode on the wall 20 of the enclosure. If the face is not in the proper position, it can be easily moved to the right position by adjusting the position of the laser line from the face of the club.

The location of switch 17 on the gripping region of the shaft makes it easy of the user to reach the switch while maintaining a grip on the device. The reason for having two ON positions for the switch is that the user does not need to always have the club face diode on and can save battery life by turning it off when not needed. The other two laser diodes continue to operate until the switch is completely off.

Figure 7:
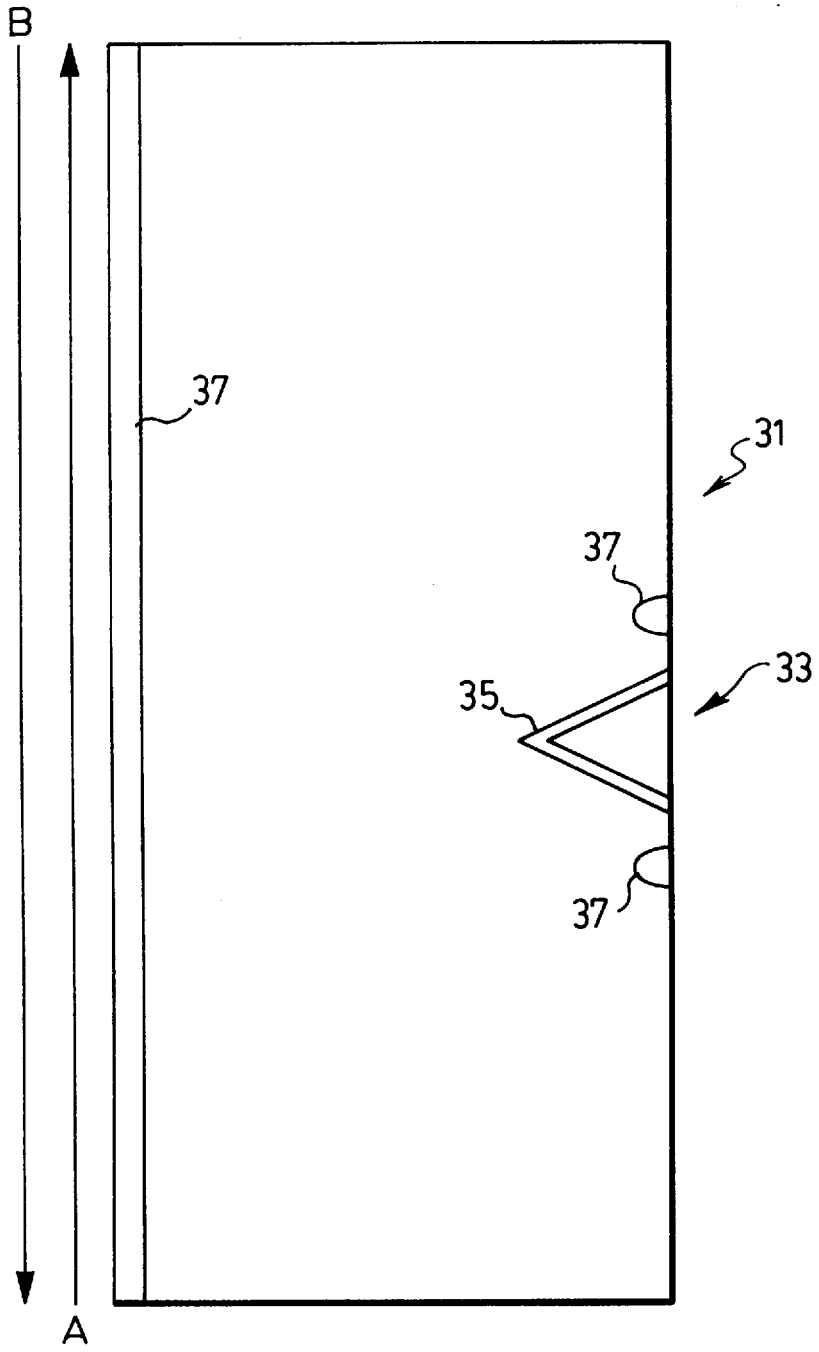
FIG. 7 is a top view of a training mat according to still a further preferred embodiment of the invention.

FIG. 7 of the drawings shows a golf swing training surface in the form of a mat 31 which is again usable with swing training device 1. Mat 31 can be used either in conjunction with or separately from enclosure 20.

Mat 31 has a set up region generally indicated at 33 for the user. Set up area 33 includes foot positioning indicators 37 as well as a triangular outline 35. The user locates his or her arms above the triangular outline for proper arm positioning during set up for a swing motion.

The mat further includes an elongated strip 37 extending completely along the edge of the mat opposite to the set up region for the user.

When the user, standing in the set up region initiates a back swing with a bottom face and shaft diodes turned on the bottom face laser line should be directed along strip 37 for a proper swing path. At the rear part of the back swing the bottom face laser line starts to climb upwardly off of the mat at which point the shaft diode laser line appears on the strip 37. The shaft diode laser line continues to trace a path along the strip until the back swing is completed. This sequence of events ensures proper body rotation and arm positioning during the back swing.

As earlier mentioned, proper hand positioning can be determined any time during the back swing by moving switch 17 into the second on position activating the diode in the front face of the club to determine proper club head orientation.

In order to produce a proper down swing and follow thru, the sequence of events as described above, is again repeated but in reverse order, i.e. the laser line from the upper end of the shaft is moved along strip 37 in the direction of arrow B during the first part of the down swing and thereafter the laser line from the bottom face of the head of the device continues along the strip again in the direction of arrow A.

In all of the above swing positions, the exact location of each of the club parts can be determined because of the extreme focus provided by the laser line on the feedback surface substantially regardless of the separation distance between the training device and the training surface. This is achieved because the laser light does not spread but rather maintains consistent concentration from its origin to its focal point which accounts for the pin point accuracy of the training device.

Although various preferred embodiments of the invention have been described in detail, it will be appreciated by those skilled in the art that variations may be made without department from the spirit of the invention or the scope of the appended claims.

The embodiments of the invention in which an exclusive property or privilege is claimed are defined as follows:

1. A golf swing training device which provides visual indication of club position during a club swinging motion, said device having a golf club shape including a shaft portion with an upper end for gripping the device and a lower end to which a head portion is secured, said head portion including a bottom face and a front face and said device including a first laser diode which produces a first laser line from the upper end of the shaft and second and third laser diodes which produce second and third laser lines respectively from the bottom face and the front face of the head portion, each of said laser lines emanating from said device as a concentrated beam to impinge and be readily visible on a training surface remote of said device for independently tracking movement of said shaft, said bottom face of said head portion and said front face of said head portion during the back swing.

2. A golf swing training device as claimed in claim 1, wherein said head portion includes an insert on which said front face is formed and in which said third laser diode is located, said insert being reversible in said head portion for varying position of said front face to accommodate both right and left handed users.

3. A golf swing training device as claimed in claim 1, wherein all of said laser diodes are operated from a single control switch, said single control switch having a first ON position in which only said first and second laser diodes are activated, and a second ON position in which all of said laser diodes are activated.

4. A golf swing training device as claimed in claim 3 in which said switch is provided on said shaft near said upper end thereof.

5. A golf swing training device which provides visual indication of club position during a club swinging motion, said device having a golf club shape including a shaft portion with an upper end for gripping the device and a lower end to which a head portion is secured, said head portion including a bottom face and a front face and said device including first lighting means which produces a first light from the upper end of the shaft and second and third lighting means which produce second and third lights respectively from the bottom face and from the front face of the head portion, each of the lights being visible under all lighting conditions and emanating from said device as a concentrated beam to impinge and be readily visible on a training surface remote of said device for independently tracking movement of said shaft, said bottom face of said head portion and said front face of said head portion during the back swing.

6. A golf swing training device as claimed in claim 5, wherein each of said lights is of a light type which does not spread and is of consistent concentration from the training device to a location outwardly away from the training device.

* * * * *